US005964007A

United States Patent [19]

Wisniewski et al.

[11] Patent Number: 5,964,007

[45] **Date of Patent: *Oct. 12, 1999**

[54] APPARATUS TO CLEAN INK AND COATING FROM CONTACT CLEANING ROLLS

[75] Inventors: Carl A. Wisniewski, Rochester; Gary W. Smallman, Fairport; Francis J. Wieloch, Penfield, all of N.Y.

[73] Assignee: Xerox Corporation, Stamford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/725,802

[22] Filed: Oct. 4, 1996

[51] Int. Cl.[6] ..... B08B 1/00; B08B 13/00

[52] U.S. Cl. ..... 15/256.53; 15/256.5; 15/3; 15/100; 101/425; 399/352

[58] Field of Search ..... 15/256.5, 256.51, 15/256.52, 256.53, 3, 100; 101/423, 424, 425; 118/203, 261; 399/352, 357, 343, 345, 358, 347

[56] References Cited

U.S. PATENT DOCUMENTS

| | | | |
|---|---|---|---|
| 2,728,103 | 12/1955 | Benedict et al. | 15/256.53 |
| 4,033,481 | 7/1977 | Hicks et al. | 222/134 |
| 4,407,219 | 10/1983 | Dellevoet | 118/60 |
| 4,982,469 | 1/1991 | Nishiwaki | 15/3 |
| 5,198,243 | 3/1993 | Shimizu et al. | 15/256.53 |
| 5,251,348 | 10/1993 | Corrado et al. | 15/256.53 |
| 5,275,104 | 1/1994 | Corrado et al. | 15/256.53 |
| 5,337,767 | 8/1994 | Ernst et al. | 118/203 |
| 5,375,285 | 12/1994 | Miura et al. | 15/256.53 |
| 5,519,914 | 5/1996 | Egan | 15/256.53 |
| 5,611,281 | 3/1997 | Corrado et al. | 101/425 |
| 5,699,738 | 12/1997 | Corrado et al. | 101/425 |
| 5,842,418 | 12/1998 | Lorrado et al. | 101/424 |
| 5,855,037 | 1/1999 | Wieloch et al. | 15/256.5 |

*Primary Examiner*—Gary K. Graham
*Attorney, Agent, or Firm*—Tammy Fair; Annette Bade

[57] ABSTRACT

A method and cleaning system to clean ink and coating from contact cleaner rolls. The contact cleaning rolls are located on a turret and as one contact cleaning roll is indexed sequentially out of contact with the imaging surface and into contact with a porous material another contact cleaning roll is indexed into contact with the imaging surface simultaneously. The porous material has a non-alcoholic solvent applied to clean the contact cleaning roll surface upon contact. The components found to create an efficient cleaning solvent for the CCRs include aliphatic ketones and alkylene halides. The aliphatic ketones are alkyl ketones containing from about 1 to 25 carbon atoms (with a preferred range of about 1 to about 10 carbon atoms). The aliphatic ketones contain solvents such as methyl ethyl ketone (i.e. the preferred solvent), methyl ketone, ethyl ketone, propyl ketone and butyl ketone. The alkylene halides are alkylene chlorides that contain about 1 to about 30 carbon atoms (with a preferred range of about 2 to about 12 carbons). The alkylene chlorides include methylene chloride, ethylene chloride and propylene chloride with methylene chloride being the preferred solvent.

10 Claims, 4 Drawing Sheets

APPARATUS TO CLEAN INK AND COATING FROM CONTACT CLEANING ROLLS

BACKGROUND OF THE INVENTION

This invention relates generally to an electrostatographic printer and copier, and more particularly, to removing ink and coating from contact cleaning rolls.

Contact cleaning rolls (CCRs) are presently used to remove dirt and particulates from a moving photoreceptor (such as an AMAT web). Often bar-code ink and solvent coatings build-up and adhere to the surface of the CCR. This ink and coating are presently hand-scrubbed off the CCRs with solvents and cloth wipes. This involves a lot of machine down time because an operator must remove any guarding and re-thread the web. Also, because the operator must reach in the coating equipment to manually scrub the CCRs, a potential safety issue is present.

The following disclosures may be relevant to various aspects of the present invention and may be briefly summarized as follows:

U.S. Pat. No. 5,519,914 to Egan discloses a cleaning cloth supply and take-up spools being mounted by rodless supports for rotation about spaced, parallel axes in a frame that is connected to a pneumatic cylinder for reciprocation between opposite ends of a rotating process roll the surface of which is to be cleaned. The cleaning cloth passes over an opening in the frame, and a sponge pressure pad, which is saturated with cleaning fluid, is mounted in the frame to reciprocate toward and away from the opening between an advanced position in which it engages, saturates and urges the registering portion of the clean cloth into contact with the surface of the rotating processing roll, and a retracted position in which the sponge is drawn into the frame completely to disengage the cloth, which therefore disengages the processing roll. The sponge pad retracts and a clean section of cloth is advanced over the frame opening each time the frame reaches one of its limit positions. The take-up and supply spool mounts are adjustable to preset the tension which is developed in the cleaning cloth during its use.

U.S. Pat. No. 4,407,219 to Dellevoet discloses a brush, especially useful for conditioning the surface of a moving body such as a fuser roll in an electrostatic copying machine, comprising a fibrous pile containing wicking fibers which project outwardly from a liquid absorbent sponge-like structure so as to conduct liquid from the sponge-like structure and apply it to the surface of the body. The pile may also contain cleaning fibers in the form of monofilaments which remove particulate matter from the surface of the body.

Application Ser. No. 08/505,931, filed Jul. 24, 1995, entitled "System for Cleaning Electrostatographic Imaging Webs", discloses a contact cleaner roll system, which includes a frame to support the system relative to a moving web having a first major surface and a second major surface, a first rotatable contact cleaner roll supported on the frame disposed for rolling contact with the first major surface of the web, a second rotatable contact cleaner roll supported on the frame disposed for rolling contact with the second major surface of the web, the second rotatable contact cleaner roll having an axis parallel to the axis of the first rotatable contact cleaner roll, the first contact cleaner roll and the second contact cleaner roll being positioned on the frame to support and guide the moving web in a substantially "S" shaped path.

SUMMARY OF INVENTION

Briefly stated, and in accordance with one aspect of the present invention, there is provided a process for removing the particles from a contact cleaning roll, comprising: removing particles from an imaging surface by contacting the imaging surface with a first contact cleaning roll located on a turret of contact cleaning rolls; indexing the first contact cleaning roll out of contact with the imaging surface and a second contact cleaning roll into contact with the imaging surface, in timed intervals; positioning the first contact cleaning roll adjacent to a porous material; applying a non-alcoholic solvent to the porous material; and contacting the first contact cleaning roll with the porous material having the non-alcoholic solvent thereon, to remove particles therefrom as the second contact cleaning roll removes particles from the second contact cleaning roll.

Pursuant to another aspect of the present invention, there is provided a process for cleaning a web, having a major surface on one side of the web and another major surface on the opposite side of the web, the process comprising: transporting the web through a substantially "S" shaped path including a clockwise curved path joined at one end with an end of a counterclockwise curved path; and maintaining at least one contact cleaning roll in rolling contact with one of the major surfaces along the inside of the clockwise curved path, maintaining at least one other contact cleaning roll in rolling contact with the other of the major surfaces along the inside of the clockwise curved path to clean both major surfaces of the web and maintaining at least a second other contact cleaning roll in rolling contact with a porous material having a non-alcoholic component thereon, for cleaning particles removed from the surface of the web, from the second other contact cleaning roll, the second other contact cleaning roll being out of contact with the major surfaces of the web.

Pursuant to another aspect of the present invention, there is provided a contact cleaner roll cleaning system, comprising: a frame to support the system relative to a moving web having a first major surface and a second major surface opposite one another; a first rotatable contact cleaner roll supported on the frame disposed for rolling contact with the first major surface of the web; a second rotatable contact cleaner roll supported on the frame disposed for rolling contact with the second major surface of the web, the second rotatable contact cleaner roll having an axis parallel to the axis of the first rotatable contact cleaner roll; the first rotatable contact cleaner roll and the second rotatable contact cleaner roll being positioned on the frame to support and guide the moving web in a substantially "S" shaped path; and a device for applying a non-alcoholic solvent to a porous material, the first rotatable contact cleaner roll and the second rotatable contact cleaner roll being positioned on the frame to be indexed, individually, into a position adjacent to the porous material, the porous material contacting one of the first rotatable contact cleaner roll and the second rotatable contact cleaner roll to remove particles therefrom while the other of the first rotatable contact cleaner roll and the second rotatable contact cleaner roll is in contact with one of the first major surface and the second major surface.

Pursuant to another aspect of the present invention, there is provided a contact cleaner roll cleaning system, comprising: a frame to support the system relative to a moving web having a first major surface and a second major surface; a first contact cleaner roll turret on the frame; and a first roll cleaner on the frame; the first contact cleaner roll turret including a plurality of rotatable contact cleaner rolls supported on the first contact cleaner roll turret; an active one of the contact cleaner rolls disposed for rolling contact with the first major surface of the web, and an idle one of the contact cleaner rolls disposed out of contact with the first major surface of the web and in operative engagement with drive means to maintain the rotational speed of the idle roll; the first contact cleaner roll turret being rotatable to sequentially place the contact cleaner rolls into and out of contact with the first major surface of the web; the first roll cleaner mounted adjacent to the idle roll on the first contact cleaner roll for movement into and out of engagement therewith and lengthwise therealong; the first roll cleaner including an absorbent cleaning material for placement against the idle roll; a second contact cleaner roll turret on the frame adjacent to the first contact cleaner roll turret; and a second roll cleaner on the frame; the second contact cleaner roll turret including a plurality of rotatable contact cleaner rolls supported on the second contact cleaner roll turret; an active one of the contact cleaner rolls on the second contact cleaner roll turret disposed for rolling contact with the second major surface of the web, and an idle one of the contact cleaner rolls disposed out of contact with the second major surface of the web and in operative engagement with drive means to maintain the rotational speed of the idle roll; the second contact cleaner roll turret being rotatable to sequentially place the contact cleaner rolls into and out of contact with the second major surface of the web; the second roll cleaner mounted adjacent to the idle roll on the second contact cleaner roll for movement into and out of engagement therewith and lengthwise therealong; the second roll cleaner having a porous cleaning material adjacent thereto, the porous cleaning material having a non-alcoholic solvent applied to the cleaning material for placement against the idle roll to remove particles therefrom; and the first contact cleaner roll turret and the second contact cleaner roll turret being positioned on the frame to guide the moving web in a substantially "S" shaped path.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same. Some contact cleaning roll systems in which the present invention can be incorporated, are described in application Ser. No. 08/505,931, filed Jul. 24, 1995 entitled "System for Cleaning Electrostatographic Imaging Webs" and is herein incorporated in its entirety.

Contact cleaning rolls (CCRs) are naturally tacky, polyurethane-coated idler rolls that clean an AMAT web. During production, automated cleaning heads traverse the length of the rotating CCRs and remove the loosely adhered particulates by scrubbing with a cloth stretched over a sponge wetted with an 80% water/20% ethanol solution. This mainly removes dirt and particulates that are attracted to the web by static charge. During the precoating phase of production, occasionally uncured bar-code ink transfers to the CCRs. Likewise, at the coating phase of production, occasionally solvent-based coatings transfer to the CCRs. Both of these transfers may leave residue (e.g. agglomerations) after the cleaning process, causing the surface of the CCR to loose its "tackiness". To restore the "tackiness", the CCRs are presently manually cleaned. This requires many steps. The precoat or coater elements are shut-down, a mechanic removes a safety panel, and then an operator stands on a ladder, reaches in and scrubs the CCR with a solvent-soaked clean-room cloth.

Figure 1:
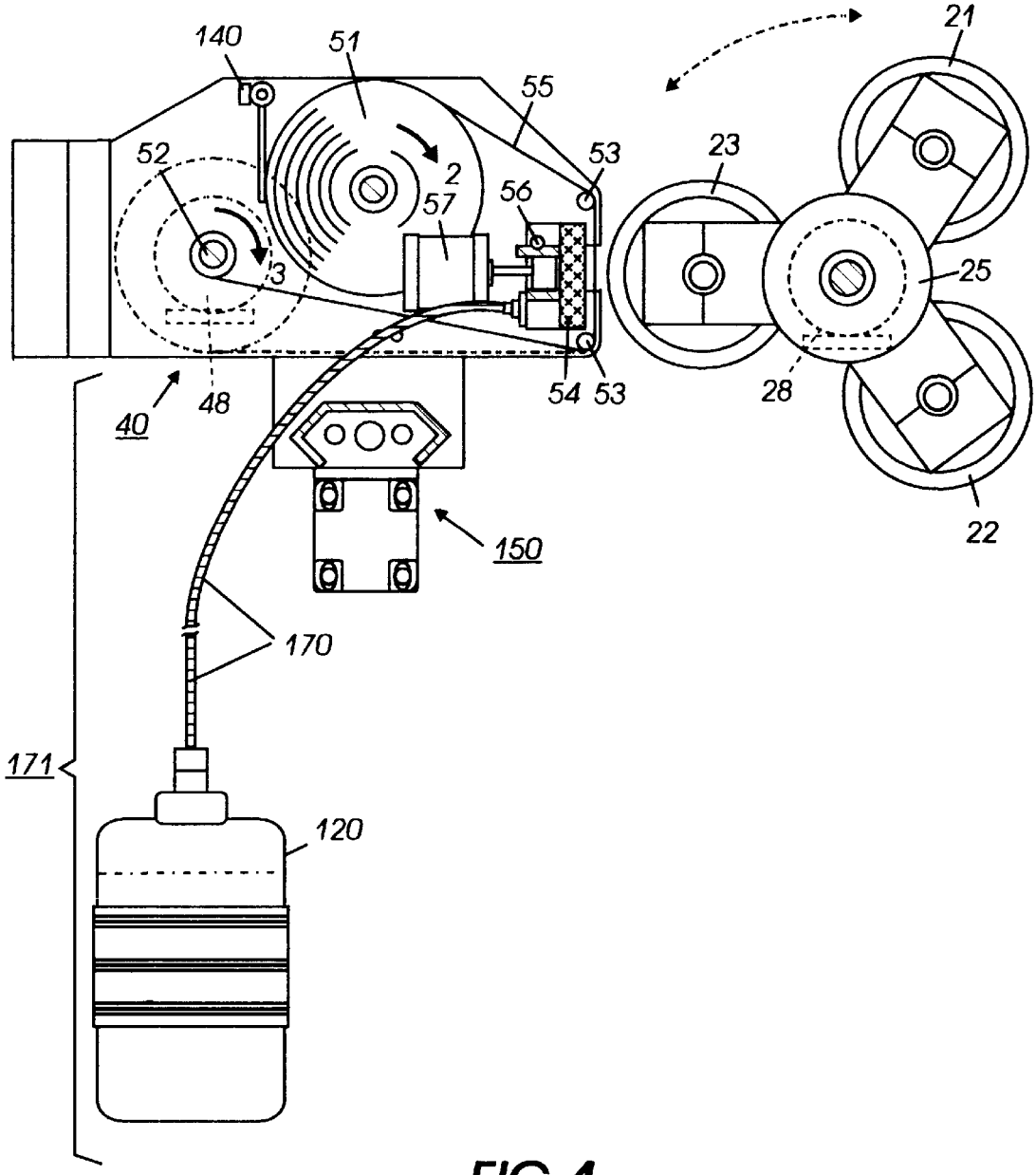
FIG. 1 is an elevational schematic end view of a manual contact cleaning roll system incorporating the present invention.

Referring particularly to FIG. 1, the cleaning head of the roll cleaner 40 is coupled to a rail apparatus 150 for traversing the length of the contact cleaning rolls 21, 22, 23. A supply spindle 51 and a take-up spindle 52 support the cleaning cloth 55. A pair of guide bars 53 define the path of the cleaning cloth 55 from the supply spindle 51 to the take-up spindle 52. A sponge pad 54 between the guide bars 53 abuts against the cleaning cloth 55. The sponge pad 54 is mounted on a backing plate 56, that utilizes an air cylinder 57 to move the sponge pad 54 into and out of contact with the CCRs. A solvent supply system 171 including, for example, a squeeze bottle (e.g. or dispensing device) 120 and a supply tube or line 170, is coupled to the back of the sponge pad 54, by the supply tube 170 in such a manner as to provide even distribution of the solvent throughout the sponge pad 54.

The supply spindle 51 is initially full, and the take-up spindle 52 is initially empty of cleaning cloth 55. The take-up spindle is driven by a motor 48 to advance the cleaning cloth 55 intermittently from the supply spindle 51 to the take-up spindle 52. The take-up spindle 52 pulls cloth from the supply spindle 51, over the guide bars 53, in the direction shown by arrows 2 and 3 on the spindles 51, 52. A no-cloth detector 140 is shown by a sensoring mechanism to signal a no-cloth condition and shut down the cleaning system of the CCRs.

The cleaning system described above with reference to FIG. 2 as well as a fluid supply system for the roll cleaner 40 are disclosed in U.S. Pat. No. 5,251,348, the entire disclosure being incorporated herein by reference.

The new method of the present invention, utilizes the existing cleaning head for scrubbing and to inject the sponge with the proper solvent needed to dissolve the ink or coating adhering to the CCRs. In the past the cleaning liquid of choice has been to use liquids inert to the cleaning member, such as water and mixtures of alcohol and water. In the present invention, solvents which dissolve the agglomerations (e.g. contamination on the CCRs) are used. Normally a solvent such as this would not be used because of the potential that the contact cleaning roll would be attacked by the solvent. However, on the occasions when a significant amount of coating materials cover the CCR after cleaning, the CCRs operate at reduced effectiveness. The agglomerations must be removed to rejuvenate the cleaning ability of the CCRs.

In the present invention, non-alcoholic components of the formula $(R\ C\ O\ R)_n\ X_y$ where R is an alkyl and X is an alkylene halide are the components used to clean the CCRs. These components are located in the solvent supply system 171. When n is the number zero or the number 1, y is the number one or the number zero, respectively. That is, when n is 0, y is 1 and when n is 1, y is 0. Experimentation at the coater and precoater modules, using these types of components, efficiently cleaned the CCRs of debris such as dried coating residue and bar-code ink. The components found to create an efficient cleaning solvent for the CCRs include aliphatic ketones and alkylene halides. The aliphatic ketones are alkyl ketones containing from about 1 to 25 carbon atoms (with a preferred range of about 1 to about 10 carbon atoms). The aliphatic ketones contain components such as methyl ethyl ketone (i.e. the preferred component), methyl ketone, ethyl ketone, propyl ketone and butyl ketone. The alkylene halides are alkylene chlorides that contain about 1 to about 30 carbon atoms (with a preferred range of about 2 to about 12 carbons). The alkylene chlorides include methylene chloride, ethylene chloride and propylene chloride with methylene chloride being the preferred component. As shown in FIG. 1, a solvent line 170 is connected to the back of the sponge plate 56 on one end. (The solvent line is not limited to this configuration. The solvent line can be connected to the sponge in any manner that enables the application of the solvent line's content to the sponge pad or like porous member.) The other end of the solvent line is attached to a "squeeze" bottle (e.g. dispensing device) 120, for the manual mode operation, filled with one of the above-disclosed solvents. It is noted that the selection of the solvent is dependent upon the solubility of the agglomerations on the CCR. Another criteria for solvent selection is safety. (e.g. The operator must take precautions to prevent flammability and exposure to fumes from particular solvents.)

The cleaning subsystem is switched to a manual mode, while the coater can remain operational and a cleaning cycle is then initialized. When the sponge contacts the rotating CCR, a solvent was applied through the solvent line and into the sponge, which then transferred to the rotating CCR. The combination of solvent, cleaning cloth, and sponge pressure efficiently removed the unwanted build-up.

Safety would be enhanced with the introduction of this new method. The CCR modules are fully enclosed with guarding panels to prevent an operator from coming into contact with any of its moving parts. The previous method of hand-cleaning required module shutdown, removal of a panel, and reaching in to clean the CCR. An automated version of this method would not require the removal of any panels, therefore the operators would not subject themselves to unsafe conditions.

Figure 2:
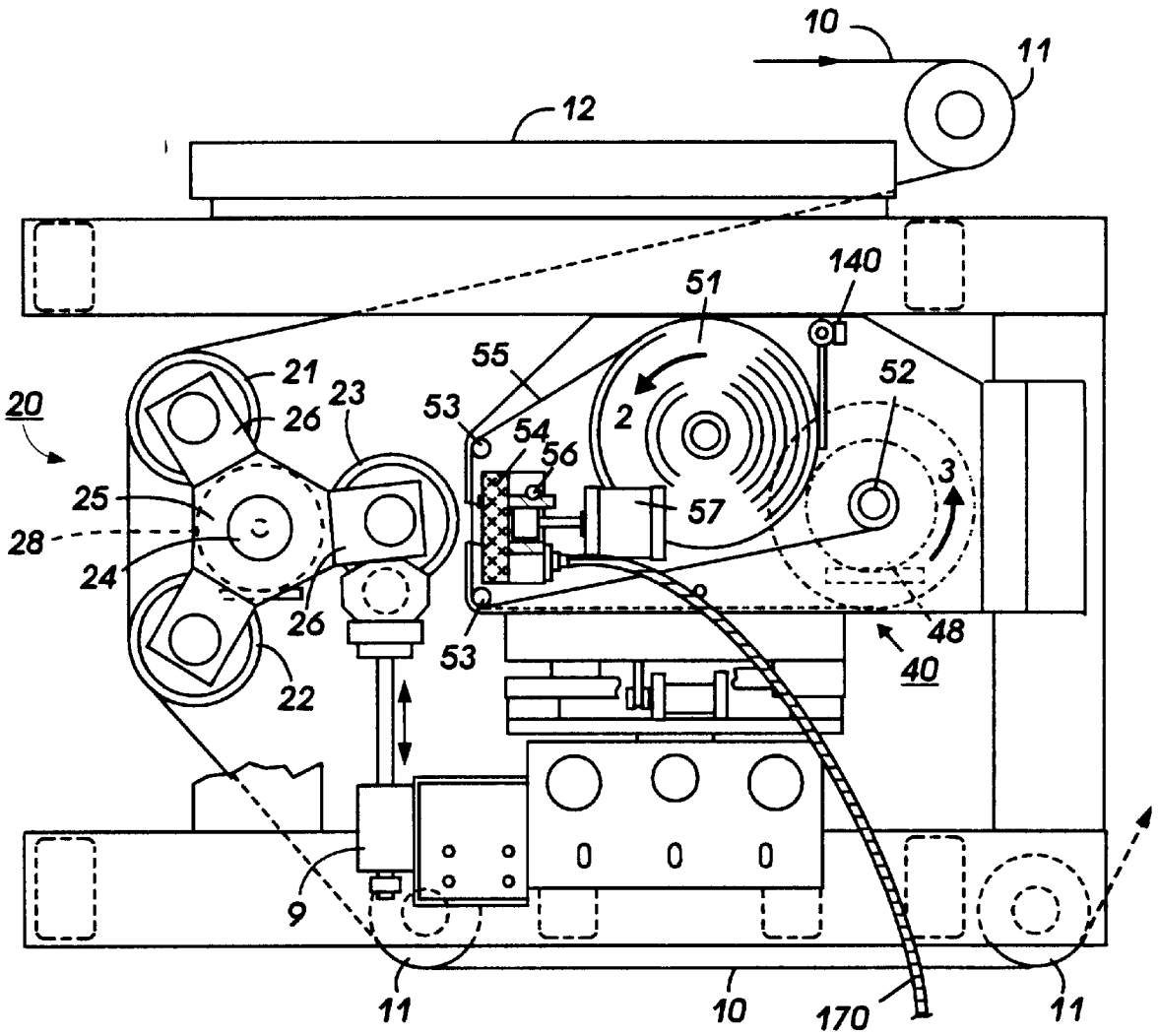
FIG. 2 is an elevational schematic end view of a contact cleaner roll system, with obscuring end structure removed.
Figure 3:
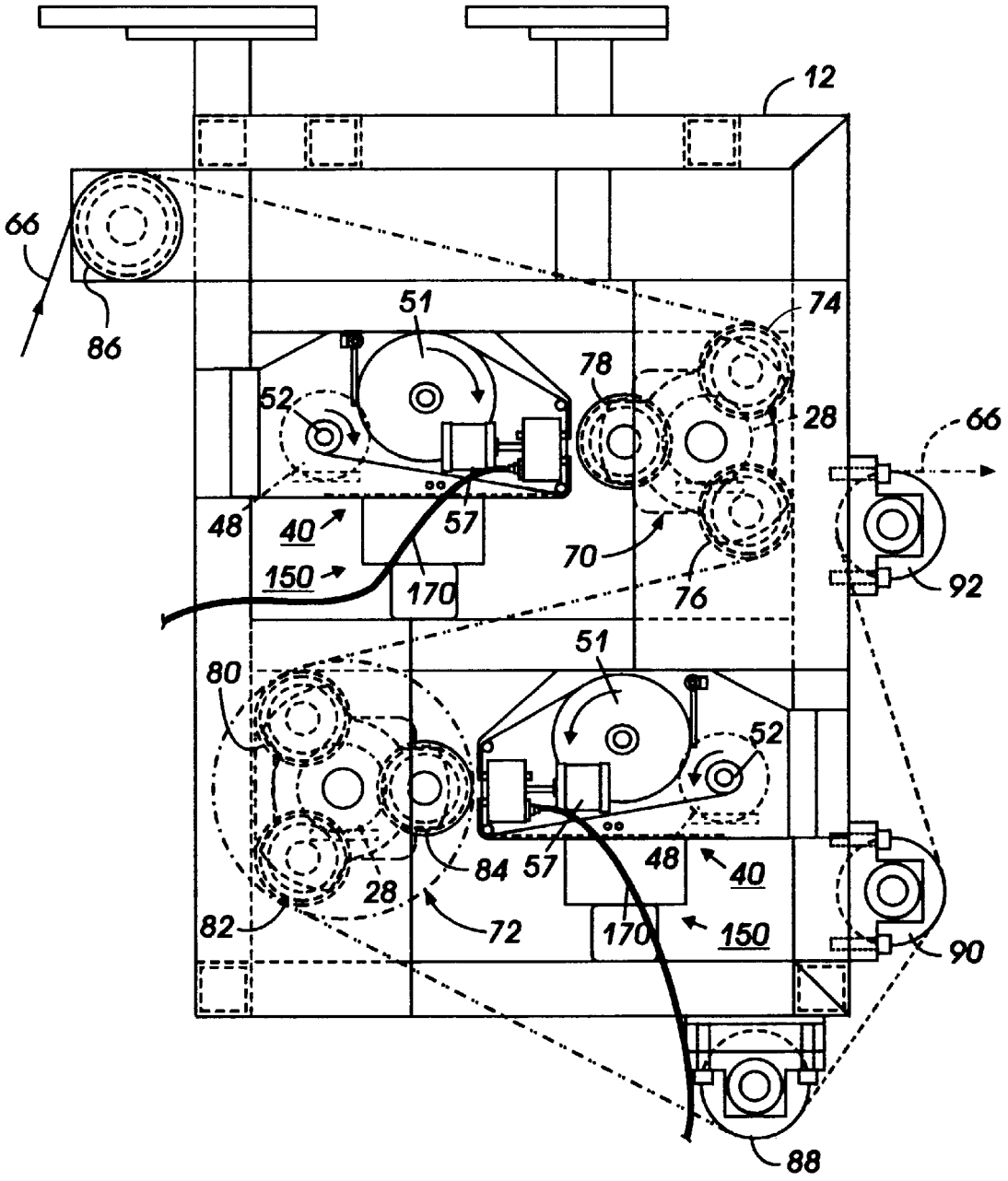
FIG. 3 is a schematic front elevation view of a cleaning system embodiment of this invention in which a plurality of contact cleaner rolls support, clean and guide a moving web in a substantially "S" shaped path.

Examples of two contact cleaner roll systems that utilize the present invention are shown in FIGS. 2 and 3.

Reference is now made to FIG. 2, which shows a contact cleaner roll system in a web processing apparatus. The web processing apparatus is indicated by a web 10 moving from left to right in a serpentine path over a series of rollers 11 on a frame 12. Web 10 has two major exposed surfaces. A contact cleaner roll turret 20, including contact cleaner rolls 21, 22, 23, is mounted on the frame 12 in the path of the web 10. The cleaner rolls 21, 22, 23 are steel rolls, coated with a polymer for a tacky surface. The tacky surfaces of the cleaner rolls, in rolling contact with a major surface of the moving web 10, remove dirt particles of contamination from the major surface of web 10 as it rolls over the particles. The contact cleaner rolls in turn become contaminated and must be cleaned periodically to restore their effectiveness. A roll cleaner 40 is positioned adjacent to the contact cleaner roll turret 20 for movement into and out of engagement with it.

With continuing reference to FIG. 2, the contact cleaner roll turret 20 includes a rotatable turret shaft 24 extending from end to end of the frame 12, with an end plate 25 fixed to it at each end. Each end plate includes three radial arms 26, each supporting one end of a rotatable cleaner roll. The turret shaft 24 is connected through a suitable gear train to a motor 28 and to a locking brake (not shown). The turret shaft 24 is positioned with two of its cleaner rolls 21, 22 active, in rolling contact with a major surface of the moving web 10 to clean the major surface. The third cleaner roll 23 is out of contact with the web 10, idle and out of service for its own cleaning. The motor 28 periodically rotates the turret 20 by the appropriate amount, 120° in this example, to take one contact cleaner roll out of service and to put another contact cleaner roll into service.

The cleaning head of the roll cleaner 40 includes a supply spindle 51 and a take-up spindle 52 for cleaning cloth 55, and a pair of guide bars 53 defining the path of the cleaning cloth 55 from the supply spindle 51 to the take-up spindle 52. The sponge pad 54 between the guide bars 53 abuts against the cleaning cloth 55. The sponge pad 54 is mounted on a concave backing plate 56 that is coupled to an air cylinder that moves the sponge pad 54 and cleaning cloth 55 into and out of contact with the CCRs.

The supply spindle 51 is initially full, and the take-up spindle 52 is initially empty of cleaning cloth 55. The take-up spindle 52 is driven by a motor 48 to advance the cleaning cloth intermittently from the supply spindle 51 to the take-up spindle 52. The take-up spindle 52 pulls cloth 55 from the supply spindle 51, over the guide bars 53, in the direction of motion shown by arrows 2 and 3. The no-cloth detector is shown by reference numeral 140.

A description of a cleaning system similar to the one described above with reference to FIG. 2 is disclosed in U.S. Pat. No. 5,251,348, the entire disclosure being incorporated herein by reference.

Referring to FIG. 3, a plurality of contact cleaner roll turrets 70 and 72 are shown mounted on the frame 12 in the path of the electrostatographic imaging web substrate 66. Contact cleaner roll turret 70 includes contact cleaner rolls 74, 76 and 78 and contact cleaner roll turret 72 includes contact cleaner rolls 80, 82 and 84. The components of contact cleaner roll turrets 70 and 72 are identical to the components of contact cleaner roll turret 20 (see FIG. 2) described above. Thus, contact cleaner rolls 74, 76, 78, 80, 82 and 84 are rigid (e.g. metal, plastic) rolls, coated with a polymer for a "tacky" surface. The contact cleaner roll turrets 70 and 72 are positioned on frame 12 so that contact cleaner rolls 74 and 76 contact a first major surface on one side of electrostatographic imaging web substrate 66 and contact cleaner rolls 80 and 82 contact a second major surface on the side of electrostatographic imaging web substrate 66 opposite the first major surface. The contact cleaner roll turrets 70 and 72 are also positioned on frame 12 to support and guide moving electrostatographic imaging web substrate 66 in a substantially "S" shaped path to clean both sides of web substrate 66 in an extremely short and compact path with contact between the web substrate 86 and the contact cleaner rolls being under substantially the same pressure for more uniform cleaning results. The lateral orientation of the rollers can be adjusted to vary the wrap angle, thus providing optimal cleaning. Idler roll 86 feeds electrostatographic imaging web substrate 66 to turret 70 and idler rolls 88, 90 and 92 guide web substrate 66 away from turret 72 to the next processing station (not shown). For the sake of convenience, the expression electrostatographic imaging web substrate as employed herein is intended to include an uncoated or coated substrate component of an electrostatographic imaging member such as, for example, a film coated with a conductive layer, a film coated with a conductive layer and a charge blocking layer, and the like.

In prior systems, the CCR cleaning head can be cycled in automatic or manual mode. In either mode, the contact cleaning system is software-driven and the test for moisture presence at the cleaning head sponge is by measuring the conductance of the liquid across the back surface of the sponge. The water based solution is pumped from a pressurized pot to the sponge when the preset conductivity level drops below its setpoint in systems prior to the present invention. This conductivity measurement is eliminated in the present invention.

Figure 4:
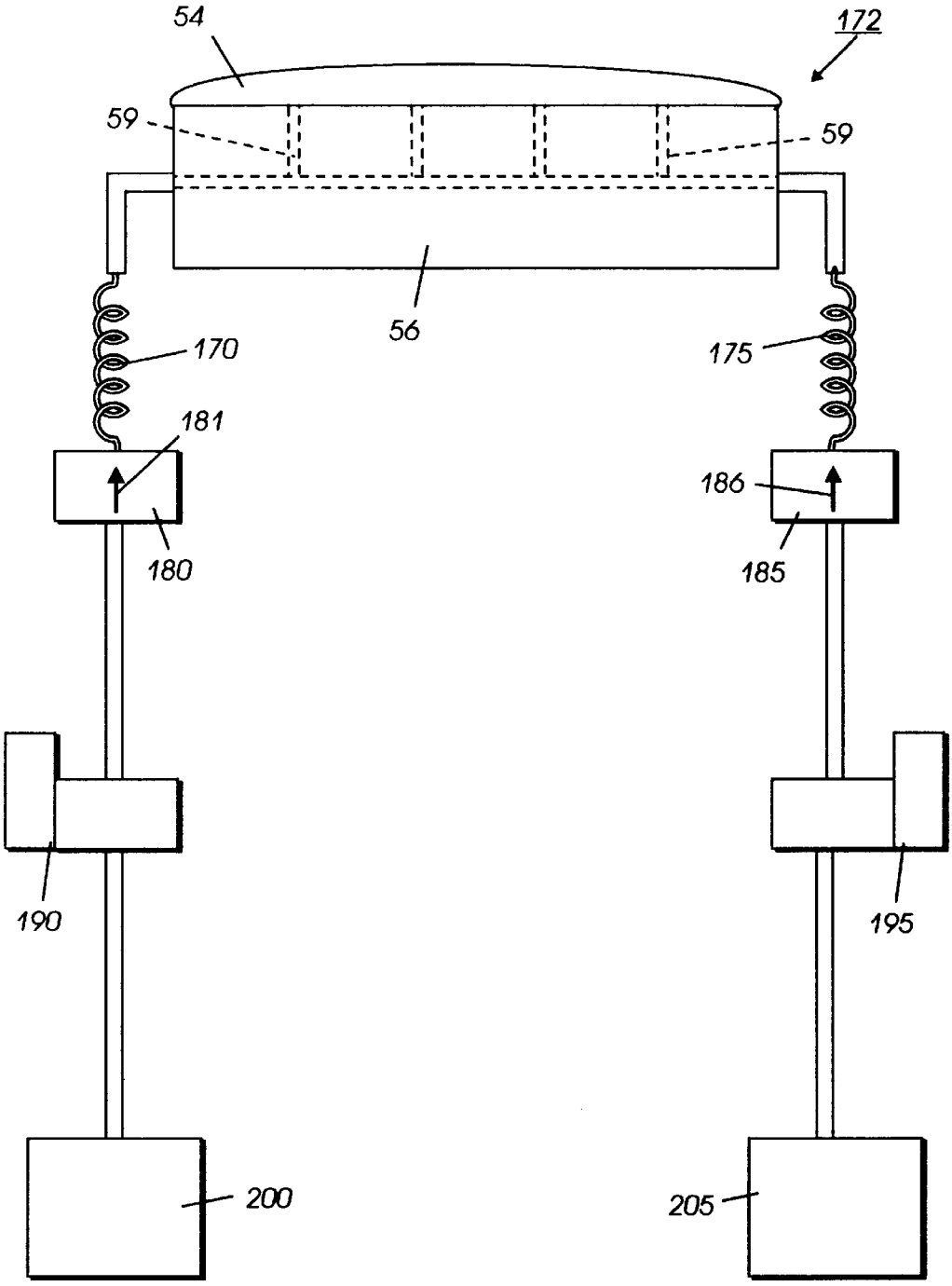
FIG. 4 is an elevational schematic of an automated contact cleaning roll system incorporating the present invention.

Reference is now made to FIG. 4, which shows an automated embodiment 172 of the present invention. In the automated mode of the present invention, additional hardware and plumbing parallel to the existing system is required to supply the periodic cleaning solvent to the sponge pad 54, in addition to and separate from the regular cleaning solution. Separate supply lines 170, 175 are shown from the sponge pad 54 to separate solution/solvent pots 200, 205. The solution pot 205 contains solution inert to the cleaning member such as an ethanol/water solution, as discussed above, for common cleaning of the CCRs. The solvent pot 200 contains a solvent, as disclosed above, for periodic cleaning of the CCRs, at timed intervals, to remove stubborn agglomerations that adhere to the CCRs and are not removed by the standard cleaning solution. To prevent mixture of the cleaning solution with the cleaning solvent, separate supply lines 170, 175, are used with check valves 180,185 or a similar device that enable flow of the line's contents in only one direction (see arrows 181, 186). A solenoid valve or similar system 190,195 forces the solvent or the solution from their respective pots 200, 205 through the check valve 180, 185 and the supply line into the sponge.

The system software is then modified to allow for automated delivery of the solvent. Only one of the components (solution 205 or solvent 200) is being pumped through it's supply line at any given time. That is, when the common cleaning method is operational, the solvent cleaning method side is non-operational. When the solvent cleaning method is operational, the solution cleaning side of the apparatus is non-operational. This prevents mixing of the solvent with the solution. An example of even distribution is shown in this Figure by the flow of the solution or solvent from the respective pot 200, 205 to a sponge pad 54, containing orifices 59, through which solution or solvent, as the case may be, is applied throughout the sponge pad 54.

In recapitulation, the present invention utilizes non-alcoholic components of the formula $(R\ C\ O\ R)_n\ X_y$ where R is an alkyl and X is an alkylene halide are the components to clean the CCRs. These components are located in the squeeze bottle and applied to the sponge to regain the "tacky" consistency of the contact cleaner rolls. When n is the number zero or the number 1, y is the number one or the number zero, respectively. That is, when n is 0, y is 1 and when n is 1, y is 0. Experimentation at the coater and precoater modules, using these types of components, efficiently cleaned the CCRs of debris such as dried coating residue and bar-code ink. The components found to create an efficient cleaning component for the CCRs include aliphatic ketones and alkylene halides. The aliphatic ketones are alkyl ketones containing from about 1 to 25 carbon atoms (with a preferred range of about 1 to about 10 carbon atoms). The aliphatic ketones contain components such as methyl ethyl ketone (i.e. the preferred component), methyl ketone, ethyl ketone, propyl ketone and butyl ketone. The alkylene halides are alkylene chlorides that contain about 1 to about 30 carbon atoms (with a preferred range of about 2 to about 12 carbons). The alkylene chlorides include methylene chloride, ethylene chloride and propylene chloride with methylene chloride being the preferred component.

It is, therefore, apparent that there has been provided in accordance with the present invention, a method and apparatus to clean ink and coating from contact cleaner rolls that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A web cleaning system, comprising:

a frame to support the system relative to a moving web having a first major surface and a second major surface opposite one another;

a first plurality of rotatable contact cleaner rolls supported on said frame disposed for rolling contact with said first major surface of said web;

a second plurality of rotatable contact cleaner rolls supported on said frame disposed for rolling contact with said second major surface of said web, said second plurality of rotatable contact cleaner rolls having an axis parallel to the axis of said first plurality of rotatable contact cleaner rolls;

said first plurality of rotatable contact cleaner rolls and said second plurality of rotatable contact cleaner rolls being positioned on said frame to support and guide said moving web in a substantially "S" shaped path; and a device for periodically applying a non-alcoholic solvent to a first porous material and a second porous material, wherein said non-alcoholic solvent is capable of removing agglomerate particles from said first and second plurality of contact cleaning rolls, said first plurality of rotatable contact cleaner rolls and said second plurality of rotatable contact cleaner rolls being positioned on said frame to be indexed, individually, into a position adjacent to the first porous material and the second porous material, respectively, said first porous material and said second porous material contacting one of said first plurality of rotatable contact cleaner rolls and one of said second plurality of rotatable contact cleaner rolls, respectively to remove agglomerate particles therefrom while another of said plurality of first rotatable contact cleaner rolls and said another of said second plurality of rotatable contact cleaner rolls is in contact with one of said first major surface and said second major surface.

2. A cleaning system as recited in claim 1, wherein said web comprises an imaging surface.

3. A cleaning system as recited in claim 1, wherein said device includes a dispensing bottle.

4. A cleaning system as recited in claim 1, wherein said device for applying a solvent comprises a non-alcoholic solvent chosen from a group consisting of aliphatic ketones and alkylene halides.

5. A cleaning system as recited in claim 4, wherein the non-alcoholic solvent is of the formula $(R\ C\ O\ R)_n\ X_y$, where R is an alkyl and X is an alkylene halide, and when n is the number 0, y is the number 1 and when n is the number 1, y is the number 0.

6. A cleaning system as recited in claim 1, wherein said first rotatable contact cleaner roll comprises an electrically conductive cylindrical core coated with a tacky contact cleaning material.

7. A web cleaning system, comprising:

a frame to support the system relative to a moving web having a first major surface and a second major surface;

a first contact cleaner roll turret on said frame; and a first roll cleaner on said frame;

said first contact cleaner roll turret including a plurality of rotatable contact cleaner rolls supported on said first contact cleaner roll turret; an active one of said contact cleaner rolls disposed for rolling contact with said first major surface of said web, and an idle one of said contact cleaner rolls disposed out of contact with said first major surface of said web and in operative engagement with drive means to maintain the rotational speed of said idle roll; said first contact cleaner roll turret being rotatable to sequentially place said contact cleaner rolls into and out of contact with said first major surface of said web;

said first roll cleaner mounted adjacent to said idle roll on said first contact cleaner roll turret for movement into and out of engagement therewith and lengthwise therealong; said first roll cleaner including an absorbent cleaning material for placement against said idle roll;

a second contact cleaner roll turret on said frame adjacent to said first contact cleaner roll turret; and a second roll cleaner on said frame;

said second contact cleaner roll turret including a plurality of rotatable contact cleaner rolls supported on said second contact cleaner roll turret; an active one of said contact cleaner rolls on said second contact cleaner roll turret disposed for rolling contact with said second major surface of said web, and an idle one of said contact cleaner rolls disposed out of contact with said second major surface of said web and in operative engagement with drive means to maintain the rotational speed of said idle roll; said second contact cleaner roll turret being rotatable to sequentially place said contact cleaner rolls into and out of contact with said second major surface of said web; and said second roll cleaner mounted adjacent to said idle roll on said second contact cleaner roll turret for movement into and out of engagement therewith and lengthwise therealong; said second roll cleaner having a porous cleaning material included therewith, said porous cleaning material having a non-alcoholic solvent applied to said cleaning material for placement against said idle roll to remove particles therefrom, wherein said first contact cleaner roll turret and said second contact cleaner roll turret being positioned on said frame to guide said moving web in a substantially "S" shaped path.

8. A cleaning system as recited in claim 7, wherein said web comprises an imaging surface.

9. A cleaning system as recited in claim 7, wherein the non-alcoholic solvent is chosen from a group consisting of aliphatic ketones and alkylene halides.

10. A cleaning system as recited in claim 9, wherein the non-alcoholic solvent is of the formula $(R\ C\ O\ R)_n\ X_y$, where R is an alkyl and X is an alkylene halide, and when n is the number 0, y is the number 1 and when n is the number 1, y is the number 0.

* * * * *